US007886404B2

(12) United States Patent
Chen

(10) Patent No.: US 7,886,404 B2
(45) Date of Patent: Feb. 15, 2011

(54) SEMI-FLEXIBLE HANDLE

(75) Inventor: Chien-Hung Chen, Xiamen (CN)

(73) Assignee: Xiamen Jundian House Omaments Co., Ltd., Xiamen, Fujian Province (CN)

( * ) Notice: Subject to any disclaimer, the term of this patent is extended or adjusted under 35 U.S.C. 154(b) by 213 days.

(21) Appl. No.: 11/639,699

(22) Filed: Dec. 14, 2006

(65) Prior Publication Data

US 2007/0266527 A1 Nov. 22, 2007

(30) Foreign Application Priority Data

May 18, 2006 (CN) ..... 2006 2 0084553

(51) Int. Cl.
*A47B 95/02* (2006.01)

(52) U.S. Cl. ..... 16/113.1; 16/405; 16/430; 16/436; 16/444

(58) Field of Classification Search ..... 16/113.1, 16/405, 430, 436, 444; 15/143.1; 81/177.1, 81/489; 190/39, 115
See application file for complete search history.

(56) References Cited

U.S. PATENT DOCUMENTS 2,913,080 A * 11/1959 Louik et al. ..... 16/408
4,364,150 A * 12/1982 Remington ..... 16/409
6,226,834 B1 * 5/2001 Lu ..... 16/113.1
6,550,102 B1 * 4/2003 Liang ..... 16/113.1
6,832,413 B1 * 12/2004 Applewhite et al. ..... 16/430
7,401,384 B2 * 7/2008 Chen ..... 16/431
7,409,747 B2 * 8/2008 Chen ..... 16/430
2003/0084541 A1 * 5/2003 Liang ..... 16/113.1
2004/0205938 A1 10/2004 Blauer et al.
2006/0124158 A1 * 6/2006 Lin et al. ..... 135/24
2006/0169308 A1 * 8/2006 Yen et al. ..... 135/25.4
2006/0174450 A1 * 8/2006 Chen ..... 16/436
2006/0225981 A1 * 10/2006 Lin ..... 190/115
2007/0074374 A1 * 4/2007 Chen ..... 16/431
2007/0094848 A1 * 5/2007 Chen ..... 16/431
2007/0143942 A1 * 6/2007 Fox et al. ..... 15/143.1

* cited by examiner

*Primary Examiner*—Victor Batson
*Assistant Examiner*—Emily M Morgan
(74) *Attorney, Agent, or Firm*—Greer, Burns & Crain, Ltd.

(57) ABSTRACT

A semi-flexible practical handle, includes on a rigid main part a plane. In the waist of the side opposite to this plane the inner-sink space with U-shaped cross-section is provided, which stretches toward the plane and holds gel. A U-shaped inner clip flange is set with the two ends of the rubber lagging respectively corresponding to the two ends of the U-shaped groove to clip with it, which makes its waist seal the gel in the inner-sink space. A gland is used to make tightly press on the plane of the main part the extending part stretching inwardly at the opens in the two ends of the rubber lagging, and fix it to the main part.

6 Claims, 5 Drawing Sheets

A — A

B — B

C–C

SEMI-FLEXIBLE HANDLE

TECHNICAL FIELD OF THE INVENTION

The present utility model relates to the handles of hand-held devices, such as handles of cases or bags.

BACKGROUND OF THE INVENTION

In existing hand-held devices such as umbrellas and walking sticks, their flexible handles generally include a rigid main part with a hole for a middle rod to get in on a top section, a rubber lagging covering a periphery of the main part and a gel clipped in the vacant cavity defined between the rubber lagging and the main part. In order to avoid the leak of the gel, annulars are respectively set in the peripheries of the two ends of the main part while in the two ends of the rubber lagging and inner clip flanges are respectively set to match the main part and are contained within the main part.

Additionally, a gland is provided to be fixed with the main part for tightly pressing an upper or a lower part of the rubber lagging, which makes the rubber lagging tight so as to realize a seal between the main part and the rubber lagging. When a hand exerts force to hold the flexible handle, the rubber lagging will press the gel. Under pressure the gel will change such that the external shape of the rubber lagging will conform to the shape of the hand to allow a comfortable grip. When the external force is removed, the transformed gel will move gradually and the rubber lagging will steadily recover. However, when a hand exerts a great force, for instance, when the handle is held to lift or move the case, it is preferred to directly touch part of the hand on the main part of the handle to make it easy to exert force.

SUMMARY OF THE INVENTION

The present utility model is to provide a semi-flexible handle. When a hand exerts force to hold the handle, part of the handle's external shape adjusts with the holding of the hand, resulting in a comfortable feel in one part and another part directly touching its rigid part for an easy exertion of force.

More specifically, a semi-flexible handle is provided, including a rigid main part, a rubber lagging installed in the main part and a gel clipped in the vacant cavity defined between the main part and the rubber lagging, where in a waist of a first side inner-sink space with a U-shaped cross-section is provided, which stretches toward an opposite second side and holds gel. In the main part, a second side opposite to the first side defines a plane. At the two ends of the first side in the main part, U-shaped grooves are respectively provided, which stretch toward the second side. A cross-section of the rubber lagging is U-shaped. The inner-clip flanges of the two ends of the rubber lagging, which corresponds to the above-mentioned U-shaped grooves and is respectively set and contained within said grooves. The two sides of the rubber lagging stretch inwardly at the opening. The extending parts of the two sides are respectively linked onto the second side of the main part. The waist of the rubber lagging seals the gel in the inner-sink space of the waist of the main part. A gland tightly presses the extending parts of the rubber lagging on the second side of the main part, and the gland is fixed to the main part.

In the preferred structure, at the two ends of the first side in the main part are the U-shaped grooves that are respectively set and which stretch toward the second side. The inner-clip flanges of the two ends of the rubber lagging correspond to the U-shaped grooves with U-shaped cross sections that are respectively set and clipped with the grooves. Thus, a double seal will be realized between the two ends of the main part and the rubber lagging.

In a preferred embodiment, the groove is provided in the first side of the main part. The two upper raised flanges positioned in the two sided walls of the groove are respectively formed to extend to the second side. There is an inner clip groove provided in each of the roots of the bottom ends of the extending parts of the two sides of the rubber lagging. The extending parts of the two sides of the rubber lagging are respectively connected onto the second side of the main part. The inner-clip groove provided in each root of the extending-part bottom end is clipped with the corresponding upper raised flange. Thus, a closer seal will be made between the two sides of the main part and the rubber lagging.

There is also a straight clip groove provided in each upper part of the extending parts of the two sides of the rubber lagging. The straight clip grooves respectively divide the upper parts of the extending parts of the two sides of the rubber lagging into two raised lines stretching in the direction of the length of the lagging. The bottom of the gland opens outwardly, and on the periphery a hem is provided which can cover and contain the tops of the extending parts of the two sides of the rubber lagging and the second side of the main part. In each of the two sides of the lower portion of the gland, which stretches in the direction of length, there is a straight clip groove which provides a clip flange from the root part of the hem. The gland presses tightly the two sides' extending parts of the rubber lagging on the second side of the main part. The raised lines formed inside the upper parts of the two extending parts of the rubber lagging are put into the gland. The outer raised lines are respectively clipped into corresponding chutes of the lower portion of the gland which stretch in the direction of the length. The clip flanges of the two sides of the lower portion of the gland are respectively put into the corresponding chutes in the rubber lagging which stretch in the direction of the length. The part of the hem of the lower portion of the gland, which stretches in the direction of length, covers the tops of the two sides' extending parts of the rubber lagging. The pressure of the gland over the rubber lagging focus on the edges of the two sides of the main part matching with the rubber lagging. Therefore, the seal is better.

In another preferred structure, at least the withstanding mechanism is fixedly installed in one of the ends of the above-mentioned main part. This mechanism presses the end of the rubber lagging to the end surface of the main part in the same side direction to form a tight seal.

The withstanding mechanism is a ring or lid fixed in the outer raised part of the middle of the same side's end part of the main part.

To avoid gel and rubber lagging when installing the press buttons in the gland and the main part, via holes are provided in the gland for the top surface of the press button to pass through. The main part of the press button is installed in a space defined between the grooves of the second side of the main part and the gland. It is suitable for the handles of cases or bags.

In the preferred structure for the press buttons, the middle part of the press button, has a raised surface. Additionally, a horizontal pin stretches out from each of the two sides. In each horizontal pin, a guiding hole is set to match with the two raised guiding pillars for guiding the up and down movement of the press button. A spring is set between the bottom of the press button and the grooves of the second side of the main part. Thus, the height can be controlled to be rather low while the length is quite long.

An inner hole, which opens downwardly, is set in the middle of the press button. The spring is installed in the space defined between a bottom of the inner hole of the middle of the press button and the grooves of the second side of the main part. The inner hole can be used to increase height of the spring so that the spring has enough recovery force, and the control force for the press button is large.

Another structure provided to avoid the gel and the rubber lagging during installation of the press buttons in the gland and the main part is a via hole in the gland for the end surface of the press button to pass through. In the press button via hole of the main part corresponding gland, the press button hole is opened. A spring is installed in the bottom of the press button hole. The press button, which passes through the press button hole of the gland, is installed in the press button hole of the main part. Therefore, the horizontal size may be controlled to be rather small while the height of the press button quite large. This is suitable for the hand articles such as walking sticks and umbrellas.

On the main part of the semi-flexible handle a plane is set. In the waist of the side opposite to this plane, the inner-sink space with a U-shaped cross-section is provided that stretches toward the plane and holds gel. A U-shaped inner clip flange is set with the two ends of the rubber lagging respectively corresponding to the two ends of the U-shaped groove to clip with it, which makes its waist seal the gel in the inner-sink space. A gland is used to tightly press on the plane of the main part so that the extending part stretching in at an opening in the two ends of the rubber lagging, is fixed it to the main part. Therefore, it is useful for sealing of the sides of the rubber lagging. When great force is required, the external shape of the rubber lagging adjusts with the holding of the hand which makes the fingers feel comfortable. Its rigid gland fixed with the main part directly touches the palm, which makes it easy to exert force. Because of the rigid gland's covering one side of the main part, it is convenient to avoid the gel and the rubber lagging to install the press buttons in the gland and the rubber lagging. It is not necessary to set the complete seal structure for press buttons between the rubber lagging and the main part.

BRIEF DESCRIPTION OF THE PREFERRED EMBODIMENTS

I. Embodiment One

Figure 1:
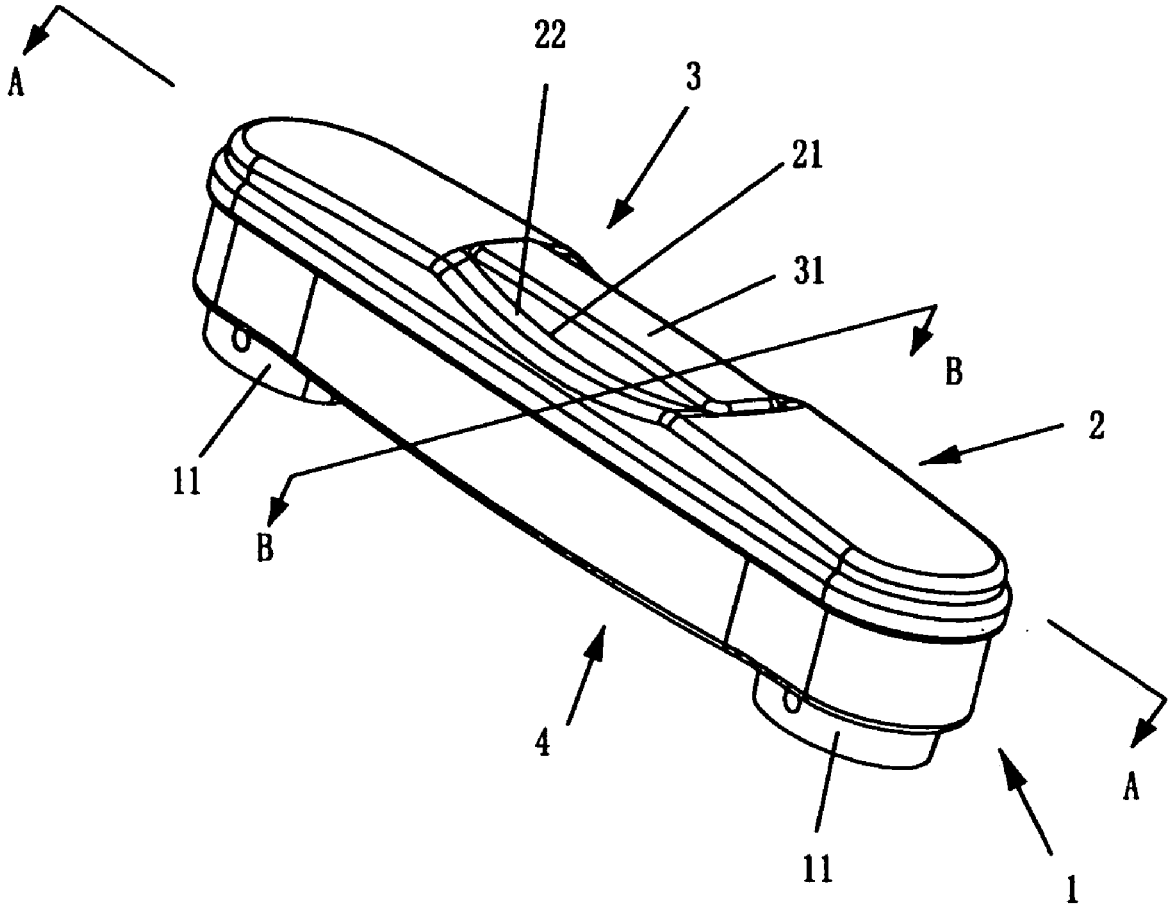
FIG. 1 is a structural schematic drawing for an embodiment of this utility model—semi-flexible handle.

An embodiment of this utility model for a semi-flexible handle is a handle for an extension rod for cases or bags. Its structure is as shown in FIG. 1. This handle has a rigid plastic main part 1, a rigid plastic gland 2, a rigid plastic press button 3, a flexible rubber lagging 4 and gel 5 clipped in the vacant cavity defined between the main part and the rubber lagging. In each of the lower parts of the two ends of the main part 1, there is a pin 11 used to respectively link with the two extension rods. The rubber lagging 4 is installed between the two pins 11 in the lower part of the main part 1. The gland 2 is fixed in the upper part of the main part 1. The press button 3 is installed in a vacant cavity defined between the main part 1 and the gland 2 and a surface 31 of the press button appears from the via hole 21 in a concave arc 22 in the middle of the gland 2.

Figure 2:
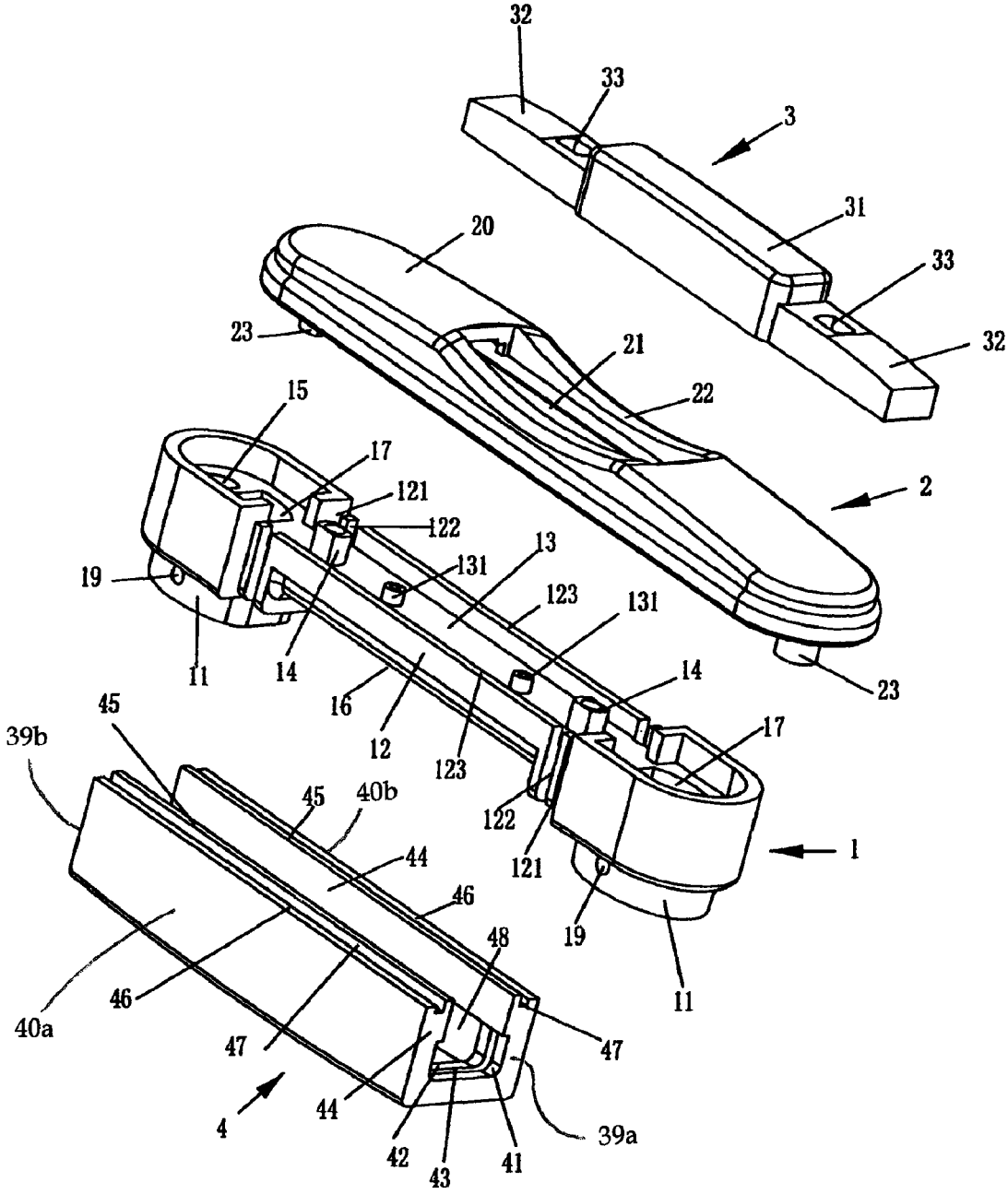
FIG. 2 is a structural schematic drawing for the unfolding of the embodiment of FIG. 1.
Figure 4:
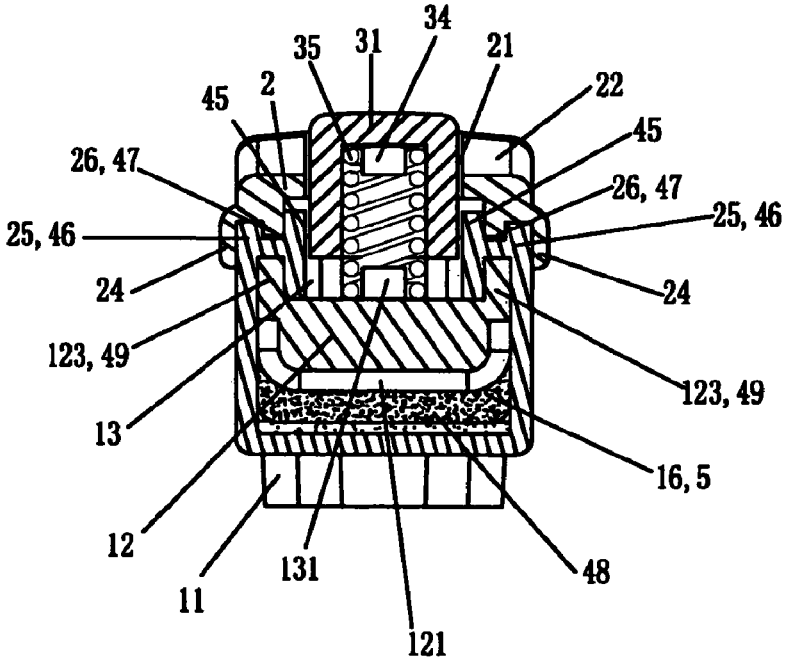
FIG. 4 is a structural schematic drawing for the Cross-section B-B of embodiment of FIG. 1.

Referring now to FIG. 2, each of the rubber lagging 4 cross-section is a long bar shaped like a U. In a right and a left end 39*a* and 39*b* are at least one first inner clip flange 41 and at least one second inner clip flange 42. The first and second inner clip flanges 41, 42 raise inwardly, are U-shaped, and stretch from the bottom to the neighboring left and right sides 40*a* and 40*b*. A U-shaped clip groove 43 is formed between the flanges 41 and 42. The two sides 40*a* and 40*b* of the rubber lagging 4 stretch inwardly at the opening. The extension parts 44 are respectively formed in the left and right sides. An inner side in the upper part of each extension part 44 is straight and horizontal. Additionally, an inner raised line or internal lip 45 and an external raised side are both straight and horizontal and external raised line or external lip 46. Between the internal and external lips 45 and 46, a straight clip groove 47 is formed. The inner side of the rubber lagging is an open space 48. Referring to FIG. 4, there is a horizontal and straight inner clip groove 49 in the root of the lower part of extension 44 of a space 48.

The main part 1 looks like a long bar. The part 12 for installing the rubber lagging 4 between the two pins 11 of the main part's right and left ends 1A, 1B wholly sink inward. The first and second grooves 121, 122 respectively stretch to a front and back long sides, are U-shaped and are respectively set in the right and left ends of the bottom long side. The waists of the bottom long sides neighboring front and back long sides further sink inward to form the inner-sink space 16 which may hold the gel 5. The long side in the top of the main part 1 is a plane, in which the groove 13 is cut to hold the press button 3. Two straight upper raised flanges 123 are formed between the front and back long sides and groove 13. In the middle of the groove 13, two raised dots located in the right 4A and left 4B ends are included to fix a spring and two raised guiding pillars 14 for the press button 3 to move up and down. An installing the hole 15 and the via hole 17, each are opened in each of the right and left ends of the bottom of the groove 13. The installing hole 15 is used to fixly install the gland 2 while the via hole 17 establishes the link between the press button 3 and inner locking parts of the extension rod. The inner holes 18 are used to cover and link the ends of the extension rod while the horizontal holes 19 install rivets for riveting the extension rod.

The gland 2 is shaped like a long bar, the bottom of which opens downwardly. In the periphery, the hem 24 is provided which can cover the tops of the main part 1 and rubber lagging 4. The sink arc 22 is set in the middle of the gland 2. The hole 15 is set in the middle of the sink arc 22 for a raised press button surface 31 in the middle of the press button 3. Now referring to FIGS. 3 and 4, an inserting pin 23 stretches out from each of the lower sided surfaces closer to the right and left ends of the gland 2. A chute 25 is set in each of the lower portions of the front and back long sides of the gland 2 to cut a clip flange 26 from a hem 24.

Figure 3:
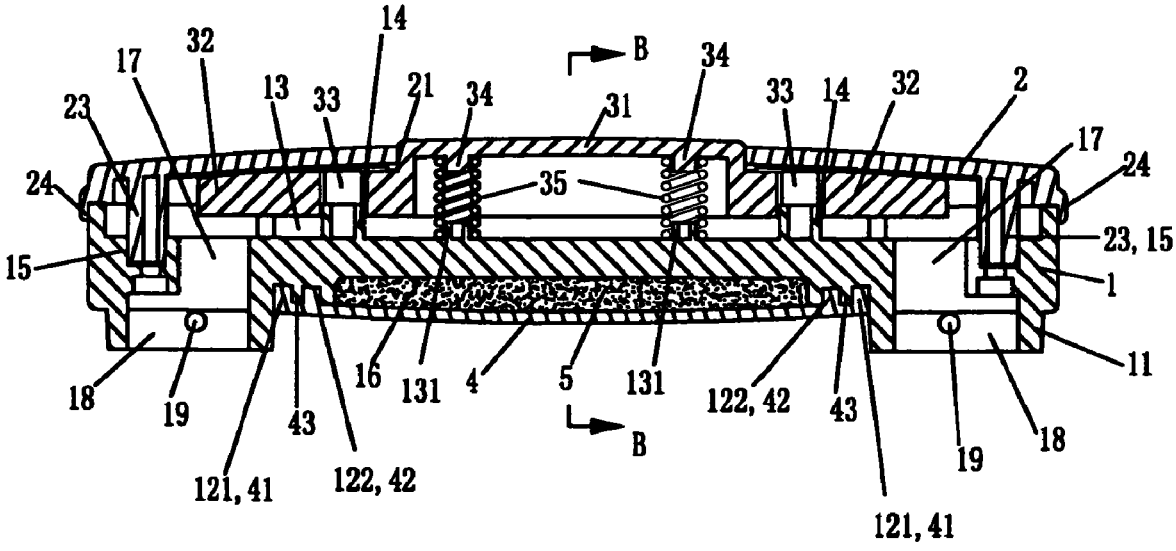
FIG. 3 is a structural schematic drawing for the Cross-Section A-A of Embodiment of FIG. 1.

The middle of the press button 3 looks like a long bar in which the inner hole opens downwardly. A lower horizontal pin 32 stretches out from the right and left sides of the press button 3, which makes the press button surface 31 raised. In each of the horizontal pins 32, there is a guiding hole 33. As shown in FIGS. 3 and 4, in the bottom of the inner hole in the middle of the press button 3, a right and left dot 34 are set for fixing the spring.

As for the process of installing each part of the embodiment and their inter relation, please refer to FIGS. 3 and 4.

Referring to FIG. 3, first put the gel 5 into the inner sink space 16 of the main part 1, then insert the rubber lagging 4 into the inner sink part 12 between the two pins 11 of the main part 1. This ensures that the first U-shaped inner clip flanges 41 at the right and left ends of the rubber lagging 4 respectively match and clip with the corresponding first U-shaped grooves 121 in the right and left ends of the main part 1. The second U-shaped inner clip flanges 42 respectively at the right and left ends of the rubber lagging 4 respectively match and clip with the second U-shaped grooves 122 of the right and left ends of the main part 1. The U-shaped clip groove 43 between the first and second inner flanges 31, 42 in each of the two ends of the rubber lagging 4A 4B, respectively clip with the raised flange between the first and second grooves of 121, 122 in the same end of the main part 1. The double seal structure formed will prevent the gel from leaking from both ends of the rubber lagging 4. Referring to FIG. 4, connect the extension parts of the two sides of the rubber lagging 4 respectively with the upper side surface of the inner sink part 12 of the main part 1. The inner clip groove 49 in the root of the lower part of each of the extension parts 44 clip with the upper raised flange 123 in the inner sink part 12 to make the front and back inner walls closely touch the corresponding front and back long sides to form the seal structure of the front and back long sides. Thus, the gel will not leak from the front and back long sides of the rubber lagging 4.

Referring to FIG. 3, a spring 34 is installed in the right and left dots 34 for fixing the spring in the inner hole in the middle of the press button 3. Next, clip the free ends of the two springs 34 respectively with the corresponding locating points 131 in the groove 13 of the main part 1, and make the guiding holes 33 in the horizontal pins 32 respectively at the right and left sides of the press button 3 respectively aligned with the corresponding guiding pillars 14 in the groove 13 of the main part 1. Align both the via hole 21 in the middle of the gland 2 with the press button surface 31 in the middle of the press button 3 and the inserting pins 23 respectively at the right and left ends of the lower portions of the gland 2 respectively aligned with the corresponding installing holes 15 in the groove 13 of the main part 1. Press the gland 2 downwardly to insert the inserting pins 23 respectively at the right and left ends of the lower portions of the gland 2 respectively into the corresponding two holes 15. This compresses the springs, and the right and left guiding pillars 14 of the main part 1 respectively stretch into the guiding holes 33 at the right and left horizontal pins 32 in the two sides of the press button 3. The hem 24 of the periphery in the bottom of gland 2 covers the top of the main part 1. Referring to FIG. 4, the inner raised lines 45 at the upper ends of the extension parts 44, which stretch inward, in the front and back long sides of the rubber lagging 4 are inserted into the gland 2 with the external raised lines clipped into the chutes in the lower portions of the front and back long sides. The clip flanges 26 in the lower portions of the front and back long sides of the gland 2 are respectively inserted into the straight clip grooves 47 in the front and back long sides of the rubber lagging 4. The hem 245 of the lower portions of the front and back long sides of the gland 2 cover the top of the rubber lagging 4. The inserting pins 23 at the right and left ends of the lower portion of the gland 2 closely match with the right and left installing holes 15 of the main part 1, which fully tightly press the gland 2 to make the bottom of the straight clip grooves 25 in the lower portions of the front and back long sides respectively tightly lean against the external raised lines 46 respectively at the sides of the front and back long sides of the rubber lagging 4. This makes the bottom of the inner clip grooves 49 of the front and back long sides of the rubber lagging 4 tightly lean against the upper end surface of the upper raised flanges 123. In this way, the gel does not leak from the front and back long sides of the inner parts of the rubber lagging 4. The press button surface 31 in the middle of the press button 3 passes through the via hole 21 in the middle of the gland 2 and exposes on the concave arc 22 of the gland 2.

When the handle is held according to this embodiment, the palm presses the handle of the gland 2 while the four fingers from forefinger to little finger lean against the rubber lagging 4. When we move or lift the case or the bag, each winding finger presses the rubber lagging 4, causing the gel 5 to be transformed by force. Thus, the external shape of the rubber lagging 4 adjusts to the winding fingers for a comfortable feel. Moreover, the palm directly touches the gland 2 fixed with the rigid main part 1 for easily exerting force.

In this embodiment, because the gland 2 and the main part 1 are linked by a transition fit with the inserting pins 23 and the installing holes 15, it is necessary to dismantle them. However, once the inserting pins 23 and the installing holes 15 are connected by static matching or sticky means, they are not able to be dismantled.

II. Embodiment Two

Figure 5:
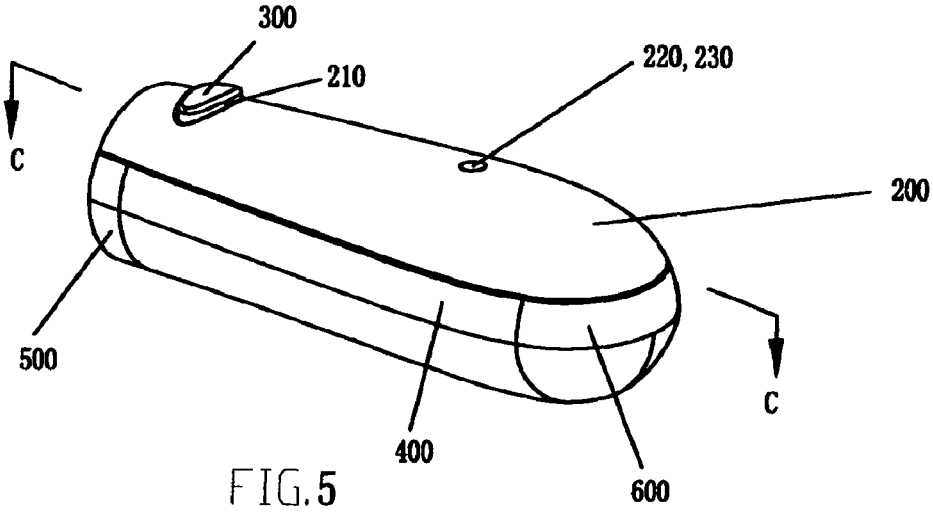
FIG. 5 is a structural schematic drawing for another embodiment of the utility model—semi-flexible handle.

Another embodiment of the utility model is a semi-flexible handle for an umbrella. Its external shape is as shown in FIG. 5. The structure of each part is shown as in FIGS. 7 and 6. A rigid plastic main part 100 hides among a rigid plastic gland 200, a flexible rubber lagging 400, a rigid plastic tail hood 600 and a rigid plastic lid ring 700. A gel 500 is clipped in the vacant cavity defined between the main part 10 and the rubber lagging 400. There is a via hole 210 for the press button in the front part of the gland 200. The top of the press button 300 stretches out from the via hole 210. There is a small hole 220 in the middle and rear part of the gland 200, which is blocked up by a plug 230.

Figure 6:
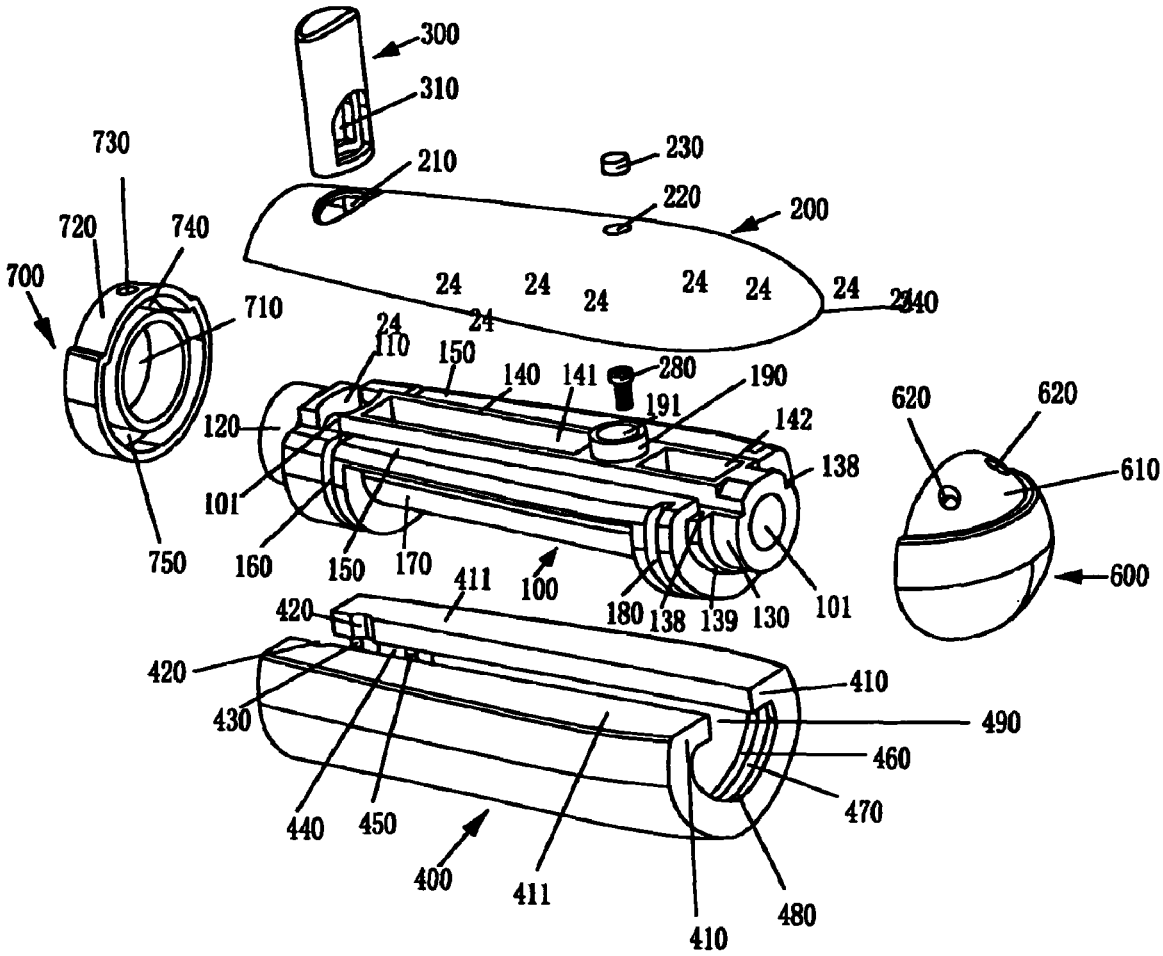
FIG. 6 is a structural schematic drawing for the unfolding of embodiment of FIG. 5.
Figure 7:
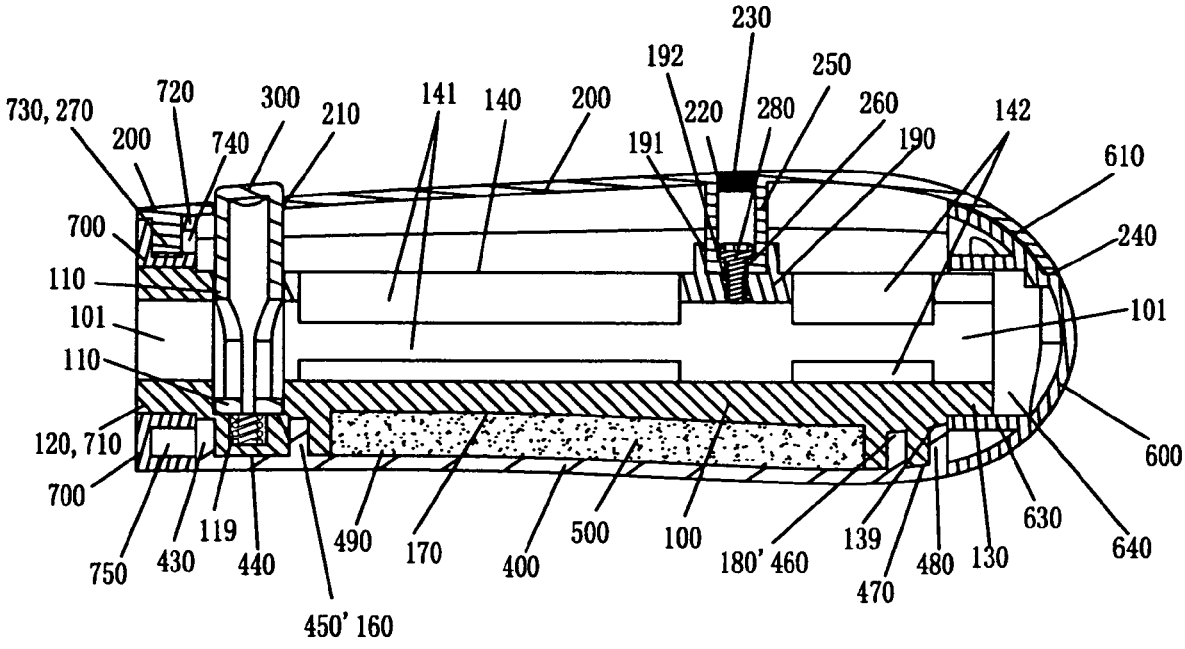
FIG. 7 is a structural schematic drawing for the Cross-section C-C of embodiment of FIG. 5.

Now referring to FIGS. 6 and 7, a press button 300 is a rigid hollow oval plastic tube. In the opening near its lower part is a via hole 310 for the umbrella middle rod to pass through. The gland 200 is a thin shell with the bottom 240 and the front end equaled and opened and its upper part is raised like an arc. In the front of the press-button via hole 210 in the lower surface of the front part of the gland 200 there is a clip pillar 270 which stretches downward to the lower surface of the small hole 220 in the middle and rear part of the gland 200. There is a screw via hole 260 in the bottom center of a tube 250.

When the main part 100 is leveled, it looks like a long cylinder with its head cut smooth. Its middle part is a pass-through hole 101 used to install the umbrella middle rod. Its front is a truncated cone 120 used to install the lid ring 700 and its rear is an echelon truncated cone 130 used to install the tail hood 600. The press button hole 110 is vertically opened in the front of the upper plane 140 of the main part 100 corresponding to the via hole 210 in the front of the gland 200. The press-button hole 110 passes through the central hole 101 to reach the lower part of the main part 100. In the bottom of the press button hole 110, a blind hole 119 is made to install the spring.

A raised truncated cone 190 is made in the middle and rear of the upper plane 140 of the main part 100 corresponding to the small hole 220 in the middle and rear of the gland 200. At the center of the upper surface of the raised truncated cone 190, a blind hole 191 is made to hold the tube 250 in the lower surface of the gland 200. A screw hole 192 is set in the center of the bottom of the blind 191 corresponding to the screw via hole 260 in the bottom of the tube 250. A square pierce 141 is opened between the press-button hole 110 and the raised truncated cone 190 in the upper pane 140 of the main part 100 to reach the bottom side wall of the central hole 101. The square pierce 142 is opened between the raised truncated cone 190 and echelon truncated cone 130 to reach the bottom side wall of the central hole 101. These two pierces of 141 and 142 are used to decrease the consume of the raw material in the main part 100. The two sides of the plane 140 in the main part 100 stretch downwardly to become a long plane 150 to link the rubber lagging 400. The U-shaped groove 160, which connects the two long planes 150, is made in the front of the lower part located in the two long planes 150 of the main part 100. Its rear U-shaped groove 180 connects the two long planes 150. A long U-shaped grove 170, which does not connect the two long planes 150, is made in the waist of the middle, and used to hold the gel 500. The two sides of the rear of the main part 100 each stretch downwardly to become a chamfered groove 138 which is lower and corresponding to the long plane 150. The two symmetrical chamfered grooves 138 are cut into the large end 139 and periphery of the small ends of the echelon truncated cone 130.

The semi-cylinder-shaped rubber lagging 400, with a U-shaped cross-section, stretches at the opening inwardly to form two opposite extension parts 410. A recession groove 420 is opened in each the front of the inner sided wall of the two opposite extension parts 410 corresponding to the press button 300. A U-shaped inner clip flange 430 is set in the front of the rubber lagging 400 to correspond to the root of the truncated cone 120 in the front of the main part 100. A U-shaped inner clip flange is set in the groove 160 of the front of the corresponding main part 100 to clip with it. A U-shaped groove 440 is formed between the inner clip flange 430 and inner clip flange 450 of the main part 100, the rear of which sets a U-shaped inner clip flange 480 to correspond to a large end echelon 139 of the root of the echelon truncated cone 130 in the main part 100. A U-shaped inner clip flange 460 is set in the groove 180 in the rear of the main part 100 to clip with it. A U-shaped groove 470 is formed between the inner clip flanges 460 and 480 in the rear of the rubber lagging 400. The long waist U-shaped groove 490 is formed between the front inner clip flange 450 and rear inner clip flange 460 of the rubber lagging 400.

A plastic tail hood 600 is a semi-sphere thin shell, in the periphery of the top of which a sink downward arc echelon 610 is opened to make room for the end of the gland 200. In the echelon 610, the two locating holes 620 respectively correspond to the two chamfered grooves 138 in the rear of the main part 100. The inner side of the tail hood 600 stretches forward to be a tube 630 so as to cover and connect the small end of the echelon truncated cone 130 in the rear of the main part 100.

A lid ring 700 is included for matching a central hole 710 and the truncated cone 120 in the front of the main part 100. The periphery of its top is cut as a sink arc echelon 710 so as to make room for the front of gland 200. A locating hole 730 is set in the echelon 710 to correspond to the clip pillar in the lower surface of the front of the gland 200. A circle shaped handicraft groove is set in the rear side of the lid ring 700 to reduce the weight. The external diameter of the upper section 740 of the circle shaped handicraft groove is smaller than the lower one 750 to make the thickness of each part of the lid ring 700 equal.

As for the process of installing each part of this embodiment and their inter relation, please refer to FIG. 7, first put the gel 500 into the long groove 170 in the inner sink space of the waist of the main part 100. Then open the extension parts 410 of the two sides of the rubber lagging 400 to make the recession groove 420 in its inner sided wall aligned with the press button hole 110 in the front of main part 100. The clip flange 430 in the front of the rubber lagging 400 is inserted into the root of the truncated cone 120 in the front of the main part 100. The inner clip flange 450 is connected with the groove 160 in the front of the main part 100. The bottom of the groove 440 in the front of the rubber lagging 400 touches the raised part of the front of the main part 100. The inner clip flange 480 in the rear of the rubber lagging 400 blocks the large-end echelon 139 in a root of the echelon truncated cone 130 in the rear of the main part 100. An inner clip flange 460 is clipped with the groove 180 in the rear of the main part 100. The bottom of the groove 470 in the rear of the rubber lagging 400 touches the raised part in the rear of the main part 100. The long groove 490 in the waist of the rubber lagging 400 covers and holds the gel 500 and the two neighboring raised parts of the main part 100. The extension parts 410 of the two sides in the rubber lagging 400 are respectively connected with the long planes 150 of the two sides in the upper plane 140 of the main part 100.

Insert the inner-sided tube 630 of the tail hood 600 into the small end of the echelon truncated cone 130 in the rear of the main part 100, and turn the tail hood 600 to make the two locating holes 620 respectively aligned with each chamfered groove 138 in the rear of the main part 100. When necessary, an axis is inserted into each of the two locating holes 620 and makes the two axes touch the vertical wall of the corresponding chamfered groove 138. After making sure the tail hood 600 is correctly fixed in the rear of the main part 100, the tail hood 600 is pressed forward to make the bottom of the periphery of the tail hood 600 and the bottom of the tube 630 press tightly against the inner clip flange 480 of the rear of the rubber lagging 400 to make a double seal structure formed by the rears of the main part 100 and the rubber lagging 400. This structure prevents the gel from leaking from the rear of the rubber lagging 400. The close transition fit can be adopted in the external of the small end of the echelon truncated cone 130 in the rear of the main part 100. The inner tube 630 of the tail hood 600 is fixed by inserting and connecting. The clearance fit will also be adopted and fixed by stickiness.

Next, insert the central hole 710 of the lid ring into the truncated cone 120 in the front of the main part 100. Then, turn the lid ring 700 to align the center of the locating holes 730 and those of the press-button holes 110 and those of the round raised platform 190. In other words, the axis line of the locating hole 730 is vertical with the upper plane 140 of the main part 100. The lid ring 700 is then pressed backwards to lean the back side of the lid ring 700 tightly against the inner clip flange 430 in the front of the rubber lagging 400. The double seal structure formed by the fronts of the main part 100 and the rubber lagging 400 prevent the gel from leaking from the front of the rubber lagging 400. The close transition fit can be adopted in the periphery of the truncated cone 120 of the front of the main part 100 and the central hole 710 of the lid ring 700 and fixed by inserting and connection. The clearance fit can also be adopted and fixed by stickiness.

The clip pillar 270 of the lower surface of the front of the gland 200 is then aligned with the locating hole 730 of the lid ring 700 and tube 250 with the blind hole 191 in the round raised platform 190 of the main part 100. The gland 200 is then pressed downward to insert the clip pillar 270 into the locating hole 730 of the lid ring 700. The tube 250 is inserted into the blind hole 191 of the raised truncated cone 90 of the main part 100. The screw 280 is next put into the tube 250 to make a screw-driving grain part pass through the rivet via hole 260. Tightly lock the screw hole 192 in the blind hole 191 of the main part 100. The end part of the gland 200 is covered in the arc echelon 610 in the periphery of the upper part of the tail hood 600. The bottom 240 of the gland 200 tightly presses on the upper surface 411 of each extension part 410 of the two sides of the rubber lagging 400. The inner wall of the long groove 490 in the waist of the rubber lagging 400 is configured to tightly touch the two sides of the main part 100. This makes the seal of the two sides of the rubber lagging 400 so gel will not leak.

Finally, a spring is put into the blind hole 119 in the bottom of the main part 100. The opening of the press button 300 is pressed downwardly and inserted into the press-button hole 110 via the press-button via hole 210 in the front of the gland 200. The umbrella middle rod is then installed in the central hole 101. The umbrella middle rod passes through the via hole 310 in the press button 300. Thus, the umbrella middle rod will not come off the press-button via hole 210 in the gland 200 and the press button hole 110 in main part 100.

When the handle is held according to this embodiment, a palm presses on the gland 200. The four fingers from a forefinger to a little finger lean against the rubber lagging 400. Squeezing the winding fingers press the rubber lagging 400, causing the shape of the gel 500 to change. Thus, the external shape adjusts with each winding finger to make the fingers feel comfortable. Bec ause the palm directly touches the gland 200 fixed with the main part 100, the fingers are comfortable squeezing the fingers or loosing them is easily accomplished while maintaining grip.

While a particular embodiment of the present Semi-flexible Handle has been shown and described, it will be appreciated by those skilled in the art that changes and modifications may be made thereto without departing from the invention in its broader aspects and as set forth in the following claims.

The invention claimed is:

1. A semi-flexible handle, comprising:

a rigid main part including a top surface and a bottom surface;

a lagging connected to said bottom surface of said main part and including a first end and an opposite second end, a first side and an opposite second side, and a first extension part connected to said first side and a second extension part connected to said second side, said first and second extension parts being generally parallel to said first and second sides and linked to said bottom surface of said main part, each of said first and second extension parts including an upper part having an external lip and an internal lip, wherein a straight clip groove is formed between said external lip and said internal lip;

a vacant cavity defined between said main part and said lagging, wherein an inner-sink space with a U-shaped cross-section is provided and stretches from said first end toward said second end, said inner-sink space being constructed and arranged for holding gel;

at a plurality of inner-clip flanges located at said first end and said second end of said lagging, said inner-clip flanges forming at least one U-shaped groove parallel to said inner-sink space and retaining said gel in said inner-sink space; and a gland that tightly engages said first and second extension parts of said lagging on said bottom surface of said main part, said gland being fixed to the main part.

2. The semi-flexible handle according to claim 1, further including a bottom of the gland that opens outwardly, and a hem which covers and contains a top of each of said first and second extension parts and the top surface of the main part, each side of a lower portion of the gland stretches in the direction of the longitudinal axis of the lagging, a straight clip groove is also provided on the bottom of the gland which includes a clip flange such that when the gland presses tightly against the upper part of each of said first and second extension parts, the internal lip is retained in the gland, and the external lip is retained in a corresponding chute of the bottom of the gland and stretches in the direction of the longitudinal axis of the lagging, the clip flanges on each side of the bottom of the gland is respectively put into a corresponding chute in the lagging.

3. The semi-flexible handle according to claim 2, wherein a via hole is provided in the gland for the top surface of a press button to pass through, a main part of the press button is installed in the space defined between grooves on the top surface of the main part and the bottom of the gland.

4. The semi-flexible handle according to claim 3, wherein in a middle part of the press button has a raised surface; a horizontal pin stretches out from a first side and a second side of the press button; in each horizontal pin, a guiding hole is set to match with a raised guiding pillar to guide the upward and downward movement of the press button installed in the grooves of the top surface of the main part, a spring is set between the bottom of the press button and the grooves of the top surface of the main part.

5. The semi-flexible handle according to claim 4, wherein an inner hole, which opens downwardly, is defined by the middle of the press button; the spring is installed in a space defined between a bottom of the inner hole and the grooves of the top surface of the main part.

6. A semi-flexible handle, comprising:

a rigid main part including a top surface and a bottom surface, the bottom surface of said main part defining a groove;

a lagging connected to said bottom surface of said main part and including a first end and an opposite second end, a first side and an opposite second side, and a first extension part connected to said first side and a second extension part connected to said second side, said first and second extension parts being generally parallel to said first and second sides and linked to said bottom surface of said main part;

a vacant cavity defined between said main part and said lagging, wherein an inner-sink space with a U-shaped cross-section is provided and stretches from said first end toward said second end, said inner-sink space being constructed and arranged for holding gel;

at a plurality of inner-clip flanges located at said first end and said second end of said lagging, said inner-clip flanges forming at least one U-shaped groove parallel to said inner-sink space and retaining said gel in said inner-sink space; and a gland that tightly engages said first and second extension parts of said lagging on said bottom surface of said main part, said gland being fixed to the main part, wherein the plurality of inner-clip flanges are positioned in the walls of the groove and are respectively formed to extend to the bottom surface of the main part, a straight clip groove is defined by each of said first and second extension parts, each of said first and second extension parts being respectively connected to the bottom surface of the main part, each of said straight clip grooves being engaged by a clip flange on a bottom of said gland.

* * * * *